US009884336B2

(12) United States Patent
Hoefte et al.

(10) Patent No.: US 9,884,336 B2
(45) Date of Patent: Feb. 6, 2018

(54) MULTIFUNCTIONAL DISPENSING DEVICE FOR DISPENSING FLUID COMPOSITIONS

(71) Applicant: The Procter & Gamble Company, Cincinnati, OH (US)

(72) Inventors: Paulus Antonius Augustinus Hoefte, Astene (BE); Olga Lahuerta Salas, Singapore (SG); Dominic Robert Doyle, Barcelona (ES); Cedric Gobber, Barcelona (ES); Ruben Garcia Fabrega, Barcelona (ES)

(73) Assignee: The Procter & Gamble Company, Cincinnati, OH (US)

( * ) Notice: Subject to any disclaimer, the term of this patent is extended or adjusted under 35 U.S.C. 154(b) by 91 days.

(21) Appl. No.: 14/511,204

(22) Filed: Oct. 10, 2014

(65) Prior Publication Data

US 2016/0101430 A1 Apr. 14, 2016

(51) Int. Cl.
*B05B 11/00* (2006.01)
*A47K 5/12* (2006.01)

(52) U.S. Cl.
CPC ..... *B05B 11/3052* (2013.01); *A47K 5/12* (2013.01); *B05B 11/0054* (2013.01)

(58) Field of Classification Search
CPC . B05B 11/0054; B05B 11/3052; B65D 47/20; A47K 5/12
USPC ..... 222/325, 206–215
See application file for complete search history.

(56) References Cited

U.S. PATENT DOCUMENTS 3,118,573 A * 1/1964 Krogsdale ..... B05B 11/047 222/212
4,456,152 A * 6/1984 Young ..... G01F 11/023 222/309
5,507,414 A 4/1996 Ong
6,269,837 B1 * 8/2001 Arent ..... B67D 7/0205 137/614.04
7,524,125 B2 4/2009 Lambert
8,550,378 B2 * 10/2013 Mazooji ..... B05B 3/02 222/181.1

(Continued)

FOREIGN PATENT DOCUMENTS

EP 2 332 453 A1 6/2011
WO WO 00/27748 A1 5/2000

(Continued)

OTHER PUBLICATIONS http://www.lysol.com/products/hand-soaps/lysol-no-touch-automatic-hand-soap-dispenser/?url=cleaning-products%2fhand-soap%2fno-touch-hand-soap-system Accessed Feb. 1, 2014.

(Continued)

*Primary Examiner* — Paul R Durand
*Assistant Examiner* — Robert Nichols, II
(74) *Attorney, Agent, or Firm* — Lauren C. Gonzalez; Gary J. Foose; Abbey A. Lopez

(57) ABSTRACT

A dispensing device is selectively operable in a first mode of operation and a second mode of operation. The device comprises a base and a refill removably connectable with the base. The base comprises a first dispensing system and a first actuator communicably connected with the first dispensing system. The refill comprises a reservoir having a sidewall and an orifice. The first dispensing system is in fluid communication with the refill in the first mode of operation and the refill is disconnected from the base in the second mode of operation.

12 Claims, 7 Drawing Sheets

(56) References Cited

U.S. PATENT DOCUMENTS

| | | | | |
|---|---|---|---|---|
| 9,033,193 | B2 * | 5/2015 | Dong | B65D 47/248 220/258.2 |
| 2005/0284888 | A1 | 12/2005 | Rhodenbaugh et al. | |
| 2008/0185399 | A1 | 8/2008 | Yang et al. | |
| 2009/0212072 | A1 * | 8/2009 | Fenton | B05B 11/0016 222/173 |
| 2011/0114669 | A1 | 5/2011 | Yang et al. | |
| 2012/0097711 | A1 * | 4/2012 | Xianzhi | A47K 5/1217 222/325 |
| 2014/0353335 | A1 * | 12/2014 | Van Diepen | A47K 5/1201 222/52 |

FOREIGN PATENT DOCUMENTS

| | | | |
|---|---|---|---|
| WO | 2010055309 | A1 | 5/2010 |
| WO | 2010055313 | A1 | 5/2010 |
| WO | 2010055314 | A1 | 5/2010 |
| WO | 2011004184 | A1 | 1/2011 |
| WO | 2011067654 | A1 | 6/2011 |
| WO | 2011135336 | A1 | 11/2011 |
| WO | 2011135337 | A1 | 11/2011 |
| WO | 2011135338 | A1 | 11/2011 |
| WO | 2012122056 | A1 | 9/2012 |

OTHER PUBLICATIONS http://www.simplehuman.com/pumps Accessed Feb. 1, 2014.
http://www.shifflerequip.com/products/Bobrick-Washroom-Equipment,-Inc./69008/BOBB826 accessed Feb. 1, 2014.
http://www.gojo.com/united-states/market/food-processing/products.aspx?sc_lang=en&disp=%7BBB347777-6C01-44C0-819F-40CE496B82AD%7D accessed Feb. 1, 2014.
http://www.cleaningshop.com.au/contents/en-us/p7542.html accessed Feb. 1, 2014.
http://www.oxo.com/p-1273-big-button-dish-soap-dispenser.aspx accessed Feb. 1, 2014.
International Search Report for International Application Serial No. PCT/US2015/054342, dated Jan. 4, 2016, 13 pages.

* cited by examiner

MULTIFUNCTIONAL DISPENSING DEVICE FOR DISPENSING FLUID COMPOSITIONS

FIELD

The present disclosure is generally directed to a dispensing device, and, more particularly, to a dispensing device for dispensing cleansing or personal care fluid compositions.

BACKGROUND

Cleaning with a cleaning or personal care composition, such as dishwashing detergent, often involves the frequent application of a detergent to a cleaning implement, such as a cloth or sponge, or directly onto the item (e.g. plate, saucepan) being washed. Current methods of applying dishwashing detergent include providing the detergent in a conventional bottle that must be picked up, inverted, and squeezed to dispense. This method of dispensing the composition may add time to the cleaning process. Additionally, this method of dispensing can be physically awkward, requiring both of the user's hands, one hand to hold the cleaning implement and the other hand to hold the bottle. Nonetheless, there are situations where a consumer may prefer a conventional cleaning composition bottle. For example, a conventional liquid bottle may be convenient for direct application onto a soiled surface, for dispensing detergent directly into the sink, and for uses that require the consumer to carry the bottle outside of the kitchen or wash room.

Wall mount dispensers exist that allow for one-handed dispensing, wherein a single hand can both actuate dispensing of the cleaning composition and hold the target surface upon which the cleaning composition is deposited. While wall mount dispensers may provide ease of use, such a dispenser may be impractical for home use. For example, mounting a dispenser on a wall in a kitchen or wash room may be inconvenient or aesthetically displeasing to a consumer.

Dispensers configured to stand on a countertop also exist. Such dispensers may be configured with sensors, such as optical sensors, for one-handed dispensing. However, due to the size, shape, or design of such countertop dispensers that allow for single-handed dispensing, it may be difficult or impractical to use such a dispenser in the situations where the user wants to carry the dispenser for use outside of the kitchen or wash room.

Thus, it would be beneficial to provide a dispensing device that involves a single-handed dispensing, while offering the flexibility to be used as a conventional dispensing container and that is capable of being placed on a rigid surface such as a countertop.

SUMMARY

Aspects of the present disclosure include a dispensing device selectively operable in a first mode of operation and a second mode of operation. The device comprises a base and a refill removably connectable with the base. The base comprises a first dispensing system and a first actuator communicably connected with the first dispensing system. The refill comprises a reservoir having a sidewall and an orifice. The first dispensing system is in fluid communication with the refill in the first mode of operation. The refill is disconnected from the base in the second mode of operation.

Aspects of the present disclosure also include a dispensing device selectively operable in a first mode of operation and a second mode of operation. The device comprises a base and a refill releasably connectable with the base. The base comprises a first dispensing system and a nozzle in fluid communication with the first dispensing system. The refill comprises a reservoir having a sidewall and an orifice; and a second dispensing system in fluid communication with the orifice of the refill. The first dispensing system is in fluid communication with the orifice of the refill.

Aspects of the present disclosure include a dispensing device comprising a base having a feed tube and a nozzle. The dispensing device includes a refill removably connectable with the base. The refill comprises a reservoir, the reservoir having a sidewall and an orifice. The feed tube of the base is releasably connectable with the orifice of the refill. The dispensing device comprises an electronic pump in fluid communication with the feed tube and the nozzle. The dispensing device comprises a first actuator communicably connected with the electronic pump and a second actuator communicably connected with the valve of the refill.

DETAILED DESCRIPTION

Figure 1:
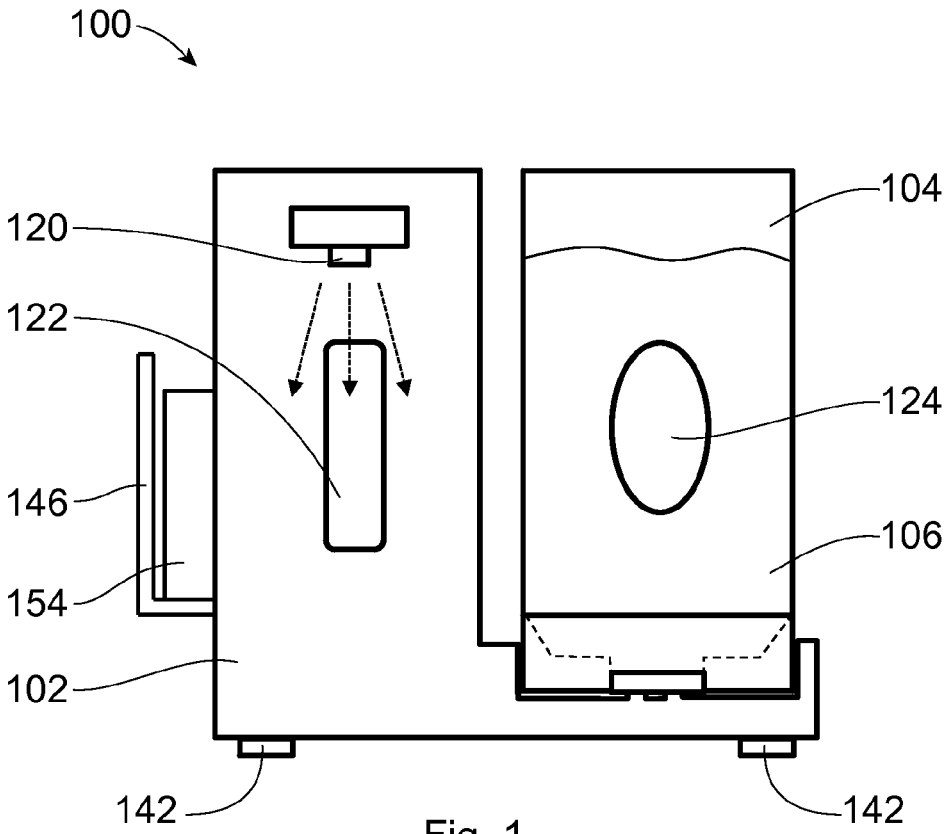
FIG. 1 is a schematic, front elevation view of a dispensing device having a base and a refill connected with the base.

Various non-limiting exemplary configurations of the present disclosure will now be described to provide an overall understanding of the principles of the structure, function, manufacture, and use of the dispensing device disclosed herein. One or more examples of these non-limiting exemplary configurations are illustrated in the accompanying drawings. Those of ordinary skill in the art will understand that the dispensing devices described herein and illustrated in the accompanying drawings are non-limiting example configurations and that the scope of the various non-limiting configurations of the present disclosure are defined solely by the claims. The features illustrated or described in connection with one non-limiting exemplary configuration may be combined with the features of other non-limiting exemplary configurations. Such modifications and variations are intended to be included within the scope of the present disclosure.

The present disclosure includes a dispensing device. The dispensing device includes a base and a refill removably connectable with the base. The refill may be configured to contain a cleaning or personal care composition. The dispensing device may be selectively operable in a first mode of operation and a second mode of operation. In a first mode of operation, a user is able to dispense a quantity of cleaning or personal care composition from the base using a single-handed action while the refill is connected with the base of the device. In a second mode of operation, a user is able to quickly remove the refill from the base and dispense a desired quantity of cleaning or personal care composition directly from the refill.

The dispensing device of the present disclosure may be used to dispense a wide range of fluid compositions in the form of liquid, gel, foam, spray, mousse, mist, and the like. The composition may be a multi-phase composition, comprising a liquid and a gas, for example. For example, the dispensing device of the present disclosure is capable of dispensing compositions such as detergents or soaps, including dish washing compositions, hand washing compositions, laundry compositions, hard surface cleaning compositions, and personal cleansing compositions. The dispensing device may also be used to dispense various other cleaning and personal care compositions. The dispensing device may be configured to dispense liquids, gels, foams, sprays, and mists of various different viscosities. It is to be appreciated that the form of the composition dispensed from the dispensing device may be different from the form of the composition contained within the refill. For example, the composition contained within the refill may be in the form of a liquid, and the composition dispensed from the dispensing device may be in the form of foam. While the present disclosure discusses the use of the dispensing device for dispensing cleaning compositions, it is to be appreciated that various compositions may be used with the dispensing device disclosed herein.

The base of the dispensing device may have a feed tube and a nozzle. The dispensing device may include a first dispensing system that is in fluid communication with the feed tube of the base for dispensing the composition from the base. The dispensing device may include a first actuator communicably connected with the first dispensing system. The refill of the dispensing device may comprise a reservoir having a sidewall and an orifice. The refill may also comprise a second dispensing system in fluid communication with the orifice of the refill and a second actuator communicably connected with the second dispensing system.

The first dispensing system may be configured as an electronic dispensing system or a mechanical dispensing system. The second dispensing system may be configured as an electronic dispensing system or a mechanical dispensing system.

The first dispensing system may be configured as an electronic dispensing system and the second dispensing system may be configured as a mechanical dispensing system.

In a first mode of operation, the orifice of the refill is in fluid communication with the feed tube of the base. In the first mode of operation, activating the first actuator triggers the first dispensing system to dispense a composition from the refill. In a second mode of operation, the orifice of the refill is disconnected from the feed tube of the base. In the second mode of operation, activating the second actuator triggers the second dispensing system of the refill to dispense the composition from the refill.

The first actuator may be configured as an electronic actuator or a mechanical actuator. The second actuator may be configured as an electronic actuator or a mechanical actuator. In some exemplary configurations, the first actuator comprises an optical sensor. In some exemplary configurations, the second actuator comprises the sidewall of the refill. In such a configuration, compression of the sidewall of the refill causes the fluid composition to release through the orifice.

Dispensing Device

Figure 2:
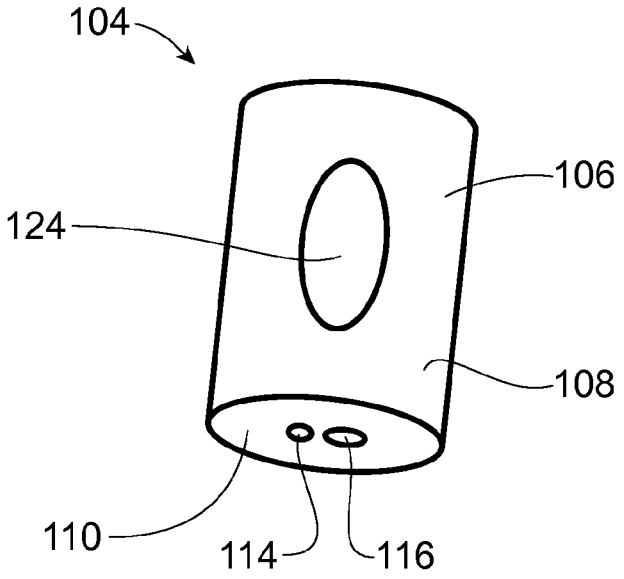
FIG. 2 is a schematic, perspective view of a refill disconnected from a base.
Figure 3:
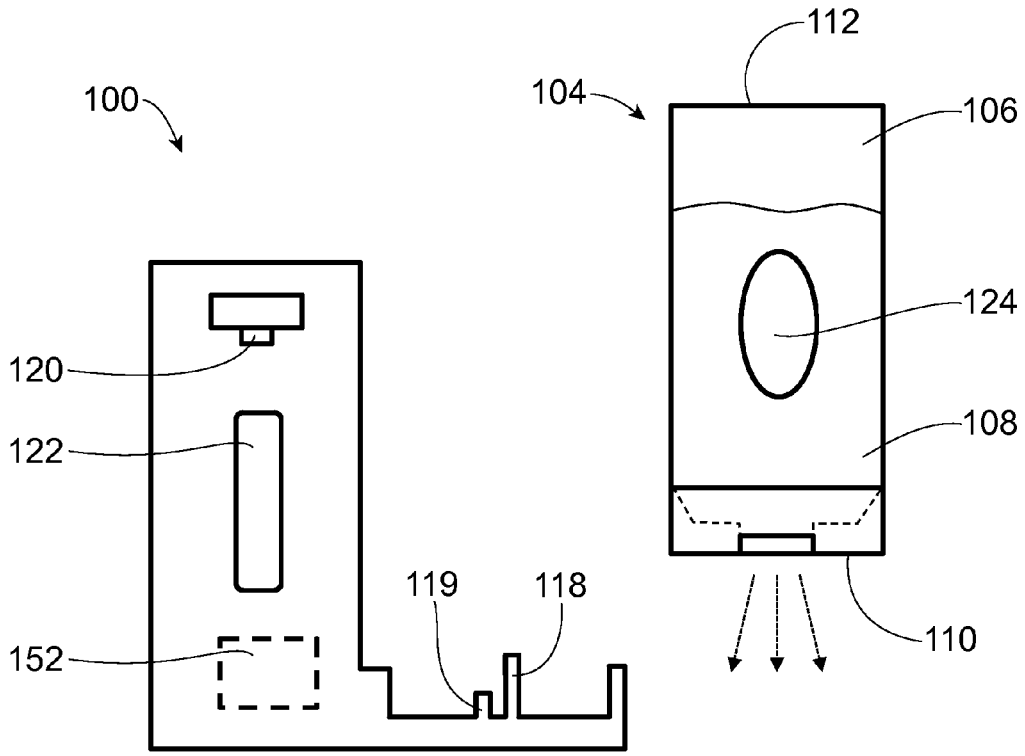
FIG. 3 is a schematic, front elevation view of a dispensing device with a refill disconnected from a base.

As shown in FIG. 1, a dispensing device 100 includes a base 102 and a refill 104 that is releasably connectable with the base 102. With reference to FIGS. 1-3, the refill 104 includes a reservoir 106 configured to contain a volume of composition. The reservoir 106 includes a sidewall 108. The sidewall 108 may terminate at a bottom wall 110 at one end and at a top wall 112 at the opposite end. The reservoir 106 also includes an orifice 114 for releasing the composition from the refill 104. As shown in FIG. 1, the reservoir may include an air vent 116 for replacing the dispensed cleaning composition volume with air to prevent drawing a vacuum. The base 102 may include a feed tube 118 that is configured to connect with the orifice 114 of the refill 104 to provide fluid communication between the refill 104 and the base 102. The base 102 may also have a nozzle 120 for dispensing the composition through the base 102.

With reference to FIGS. 1 and 2, the base 102 includes a first actuator 122 and the refill 104 may include a second actuator 124. As discussed in more detail below, in a first mode of operation, the refill 104 is connected with the base 102 and a composition may be dispensed from the nozzle 120 by activating the first actuator 122. In a second mode of operation, the refill 104 may be removed from the base 102 and the second actuator 124 may be activated to dispense a composition directly from the orifice 114 of the refill 104.

With reference to FIGS. 1-4A, the first actuator 122 may be communicably connected with a first dispensing system 130. Activating the first actuator 122 triggers the first dispensing system 130 to dispense an amount of composition from the nozzle 120 of the base 102. The first actuator 122 may be in electrical or mechanical communication with the first dispensing system 130. With reference to FIGS. 1-4B, the second actuator 124 may be communicably connected with a second dispensing system 132. Activating the second actuator 124 triggers the second dispensing system 132 to dispense an amount of composition from the refill 104. The second actuator 124 may be communicably connectable with the second dispensing system 132 in various ways, including mechanically and electrically.

The first and second dispensing systems 130, 132 may include one or more valves and/or pumps to control the flow of a composition contained in the dispensing device 100. For example, with reference to FIGS. 1 and 4A, the first dispensing system 130 may include a valve 128 disposed adjacent to the nozzle 120 of the base 102 to control release of composition from the nozzle 120. With reference to FIGS. 1 and 4B, the second dispensing system 132 may include a valve 126 disposed adjacent to the orifice 114 of the refill 104 to control release of composition from the reservoir 106. In some exemplary configurations, the valve 126 of the second dispensing system 132 may be disposed in the interior of the refill 102 adjacent to the orifice 114.

Any type of valve may be used in the first and second dispensing systems 130, 132, including mechanical valves or electronic valves. Exemplary mechanical valves include elastomeric valve, mechanical check valve, slitted elastomeric membrane, duck bill valves, umbrella valves, and the like. The valves of the first and second dispensing systems 130, 132 have open and closed configurations to control release of the composition from the refill or nozzle of the dispensing device.

Figure 4A:
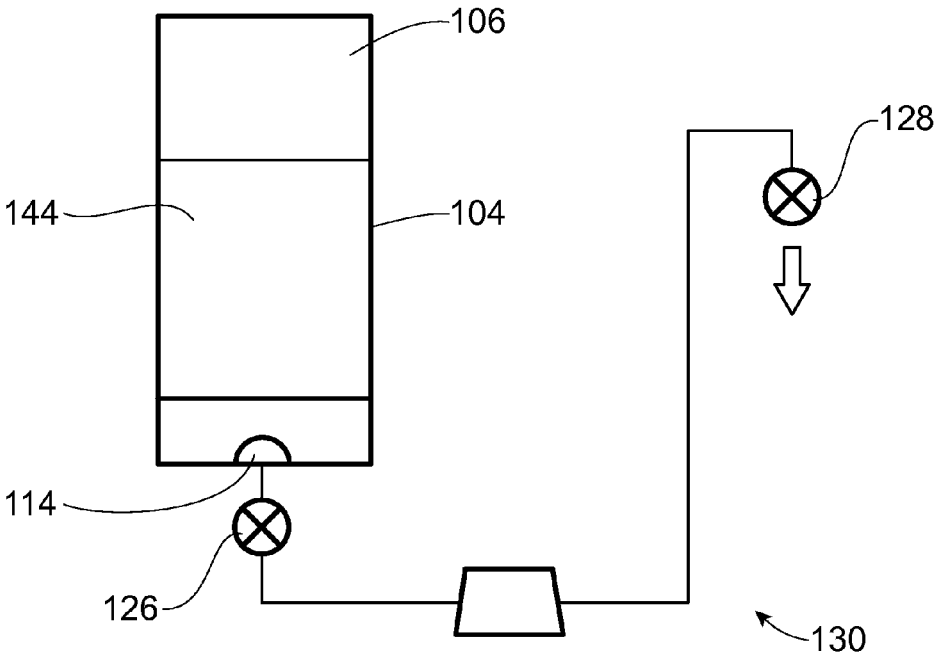
FIG. 4A is a schematic, side elevation view of a portion of a dispensing device, including a refill and a first dispensing system.
Figure 4B:
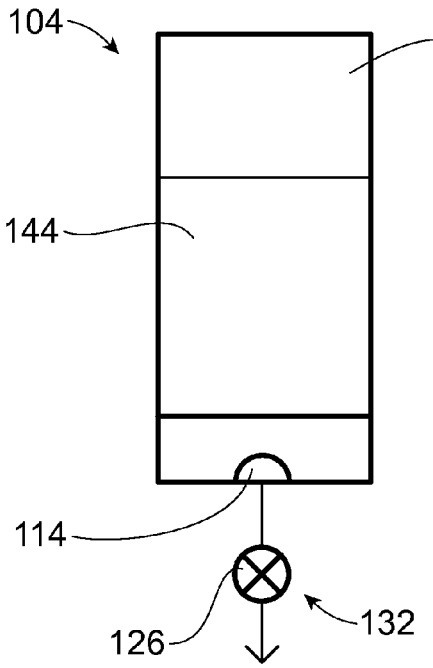
FIG. 4B is a schematic, side elevation view of a portion of a dispensing device, including a refill and a second dispensing system.
Figure 5A:
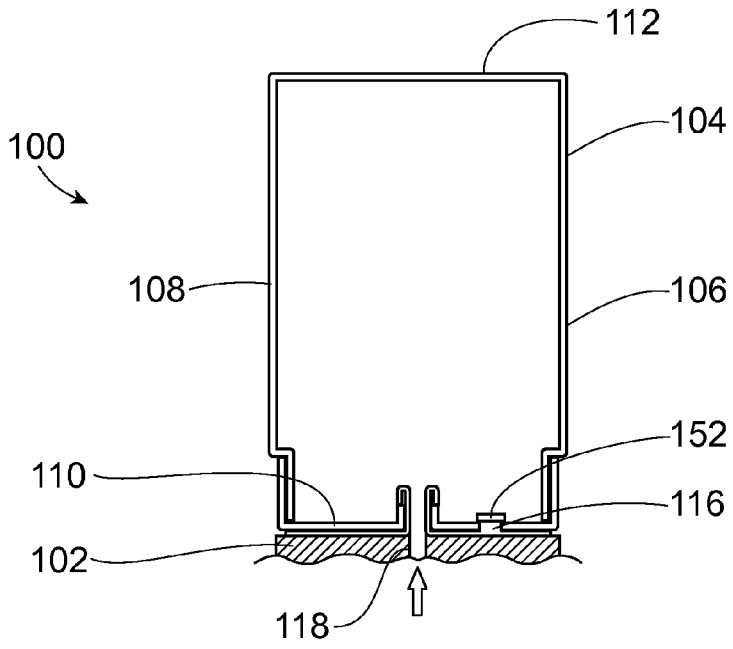
FIG. 5A is a schematic, sectional view of portion of a refill and a portion of a base of a dispensing device.
Figure 5B:
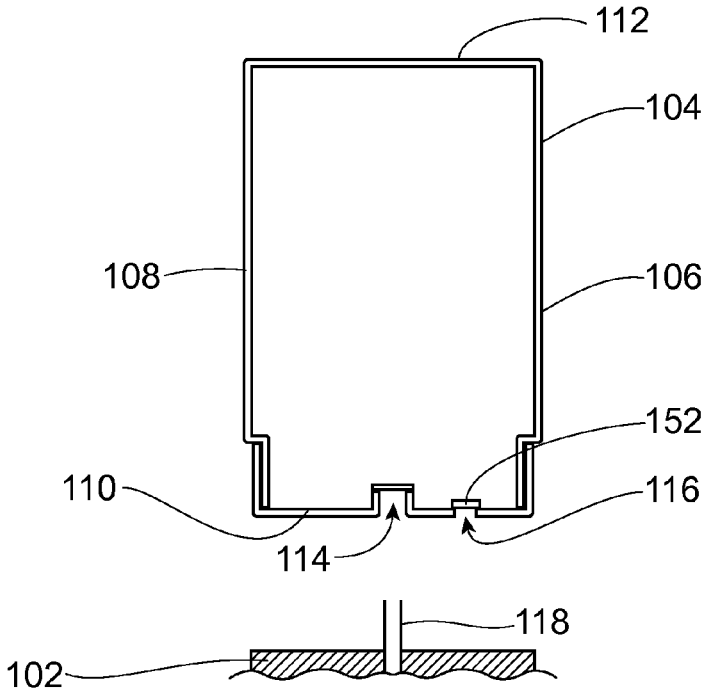
FIG. 5B is a schematic, sectional view of portion of a refill and a portion of a base of a dispensing device.

With reference to FIGS. 4A and 5A, when the refill 104 is connected with the base 102, the feed tube 118 of the base 102 may engage the valve 126 of the second dispensing system 132 to provide fluid communication between the refill 104 and the base 102. In such an exemplary configuration, the valve 126 of the second dispensing system 132 may control release of the composition from the dispensing device 100. With reference to FIGS. 4B and 5B, when the refill 104 is disconnected from the base 102, the valve 126 of the second dispensing system 132 may control the release of composition from the refill 104.

Figure 6:
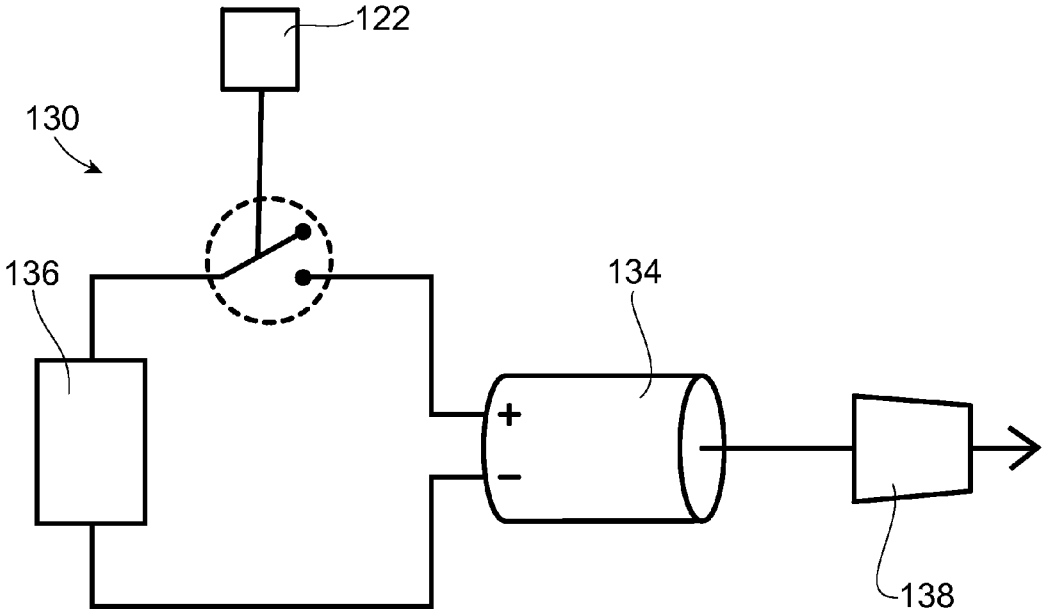
FIG. 6 is a schematic of a first dispensing system configured as an electronic dispensing system.

The first dispensing system 130 may be configured as an electronic dispensing system or a mechanical dispensing system. In a configuration comprising an electronic dispensing system for the first dispensing system 130, the electronic dispensing system, such as shown in FIG. 6, may include an electric motor 134. The electric motor 134 may power an electronic pump 138 or an electronic valve that is configured to control the flow of the composition from the refill 104. The electric motor 134 is powered by a power source 136. The power source 136 can be a battery or an AC outlet.

An electronic dispensing system may be configured in various ways. With reference to FIGS. 1-4A and 6, in some exemplary configurations, an electronic dispensing system may comprise an electronic pump 138 for delivering a composition from the refill 104 to the nozzle 120. In such an exemplary configuration, when the first actuator 122 is activated, the electric motor 134 turns on and the electronic pump 138 forces the composition from the refill 104 to the nozzle 120. Various electronic pumps may be used, including diaphragm, gear, piston pumps, peristaltic pumps, rolling bellow pumps, and the like.

Figure 4C:
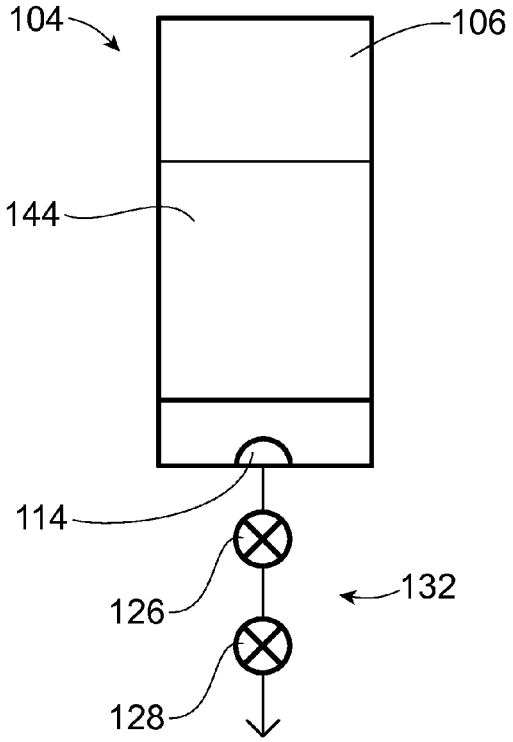
FIG. 4C is a schematic, side elevation view of a portion of a dispensing device, including a refill and a first dispensing system.
Figure 7:
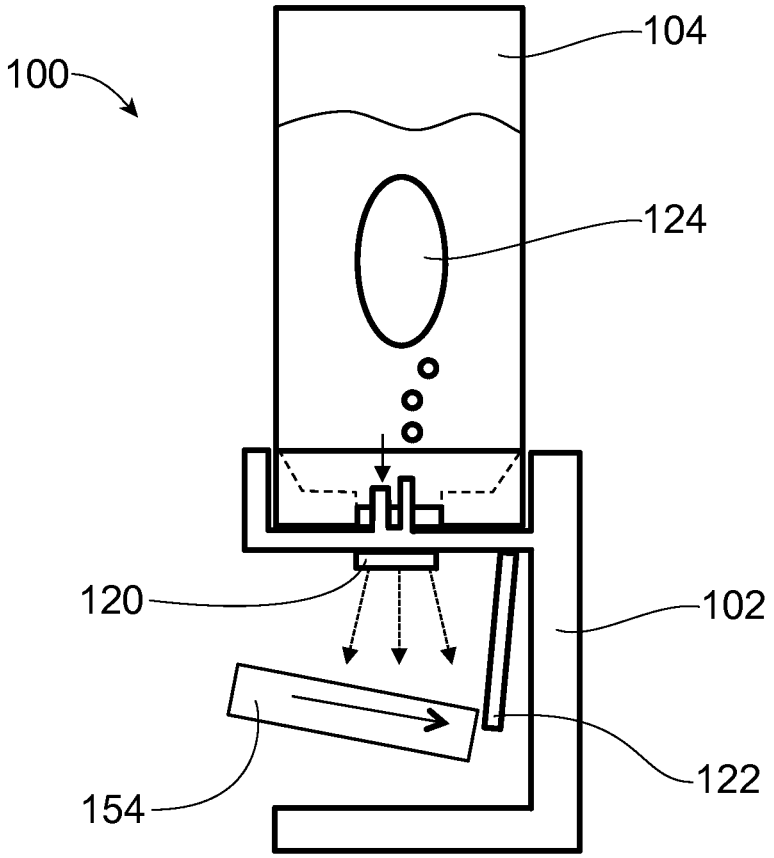
FIG. 7 is a schematic, side elevation view of a dispensing device having a base and a refill connected with the base.

In the exemplary configuration shown in FIG. 7, the composition may flow by gravity from the refill 104 to the nozzle 120. In such an exemplary configuration, the dispensing device 100 may include an electronic valve or an electronic pump. With reference to FIGS. 4C and 7, in an exemplary configuration comprising an electronic valve, once the first actuator 122 is activated, the motor 134 turns on and causes the valve 128 to open and the composition to subsequently flow out of the nozzle 120.

The electronic dispensing system may comprise a circuit board, such as a printed circuit board (PCB). The printed circuit board may provide additional functionality to the dispensing device. For example, the PCB may be used to optimize power consumption, enable timed dispensing, control a light source, and the like. The PCB may also provide a convenient mechanism for connecting the first actuator, motor, and power source. A PCB may also include an electronic member that is configured to recognize a particular refill configuration in order to ensure that replacement refills are configured to operate with the base.

Figure 8:
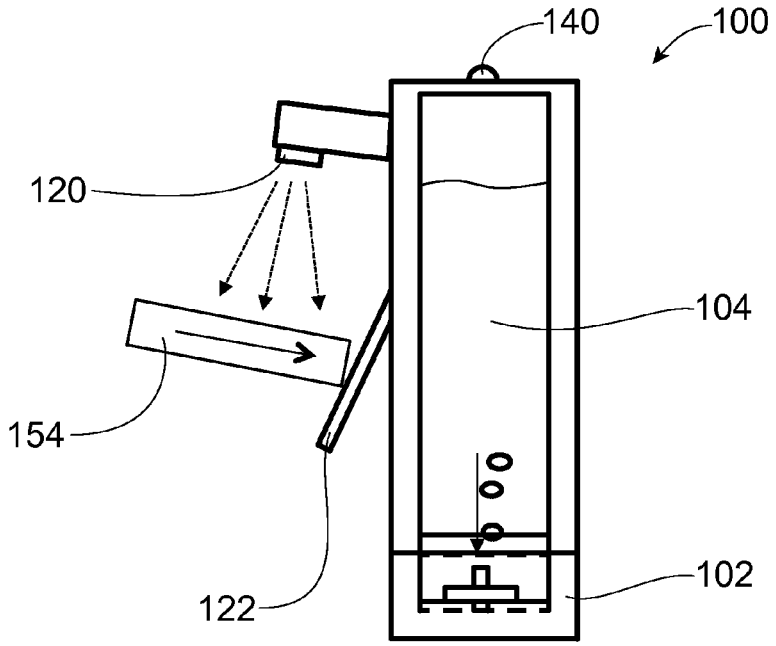
FIG. 8 is a schematic, side elevation view of a dispensing device having a power switch.

In the configuration shown in FIG. 8, the electronic dispensing system comprises a power switch 140 that is capable of controlling power to the electronic dispensing system. The power switch 140 can be configured as a toggle switch, a push-button switch, or a soft touch switch, for example. The power switch 140 can be turned to an "on" or "off" position to control the flow of electricity to the electronic dispensing system. In an exemplary configuration comprising a power switch 140, activation of the first actuator 122 of the base 102 will only trigger the electronic dispensing system to dispense a composition from the refill 104 when the power switch 140 is in the "on" position.

In some exemplary configurations, the first dispensing system 130 may be configured as a mechanical dispensing system. The mechanical dispensing system may be configured in various ways. For example, the valve 128 of the first dispensing system 130 may be configured as a mechanical valve. Exemplary mechanical valves include elastomeric valves, mechanical check valves, slitted elastomeric membranes, duck bill valves, umbrella valves, and the like. The mechanical dispensing system may include a mechanical pump. Exemplary mechanical pumps include a mechanically operated piston pump. However, any mechanical pump for pumping fluids may be used.

In the exemplary configuration shown in FIG. 7, the first dispensing system 130 of the dispensing device 100 may be configured as a mechanical dispensing system having a mechanical valve. In such an exemplary configuration, the composition may flow by gravity from the refill 104 to the nozzle 120. Actuation of the first actuator 122 may cause the mechanical valve of the first dispensing system 130 to open and the composition to dispense from the nozzle 120.

The second dispensing system 132 may be configured as an electronic dispensing system or a mechanical dispensing system. For example, the second dispensing system 132 may be configured as a mechanical dispensing system. The mechanical dispensing system may be configured in various ways. For example, the valve 126 of the second dispensing system 132 may be configured as a mechanical valve. Exemplary mechanical valves include elastomeric valves, mechanical check valves, slitted elastomeric membranes, duck bill valves, umbrella valves, and the like. The mechanical dispensing system 132 may also include a mechanical pump. Exemplary mechanical pumps include a mechanically operated piston pump, peristaltic pumps, rolling bellow pumps, and the like. However, any mechanical pump for pumping fluids may be used.

With reference to FIG. 2, the refill 104 may be configured such that the composition contained therein may be poured from the refill 104 when the refill 104 is disconnected from the base 102. For example, the composition may flow freely from the reservoir 106 and through the orifice 114 onto a target surface. In such an exemplary configuration, the second dispensing system may include a mechanical valve that opens by the force of the composition contained within the refill applying pressure to the valve. In another exemplary configuration wherein the composition is able to flow freely from the refill when the refill is disconnected from the base, the second dispensing system may not comprise a valve such that the composition is unrestricted from flowing out of the orifice of the refill.

The second dispensing system 132 may include an electronic dispensing system. The electronic dispensing system may include an electric motor. The electric motor may power an electronic pump or an electronic valve that is configured to control the flow of the composition from the refill. The electric motor may be powered by a power source. The power source can include battery or an AC outlet.

The electronic dispensing system may be configured in various ways. In some exemplary configurations, the electronic dispensing system may comprise an electronic pump for delivering a composition from the refill to the nozzle. In such an exemplary configuration, when the second actuator of the base is activated, the motor turns on and the electronic pump forces the composition from the refill. Various electronic pumps may be used, including diaphragm, gear, piston pumps, and the like. In some exemplary configurations, the valve of the second dispensing system may be configured as an electronic valve to control the flow of composition from the refill.

The electronic dispensing system may comprise a circuit board, such as a printed circuit board (PCB).

Figure 9:
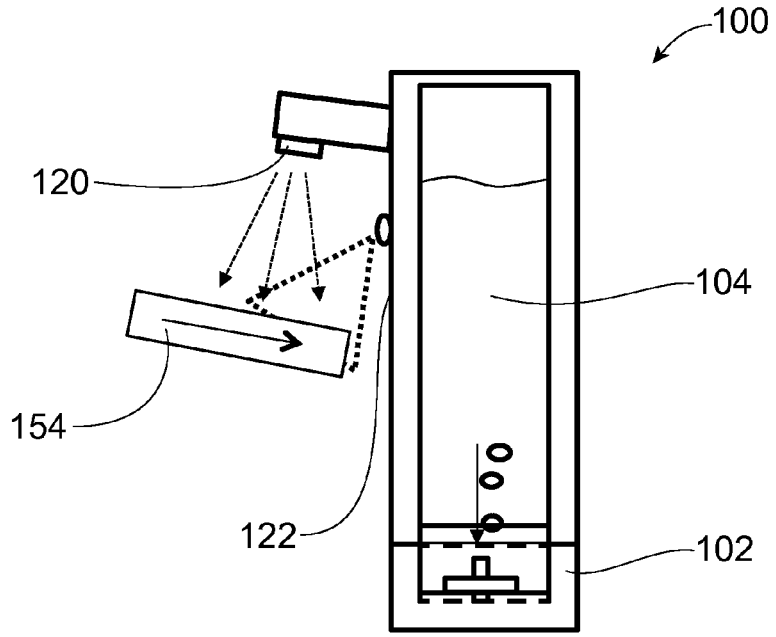
FIG. 9 is a schematic, side elevation view of a dispensing device having a first actuator configured as a sensor.

The first and second actuators 122, 124 of the dispensing device 100 may be configured in different ways. For example, the first actuator 122 may be configured as a mechanical actuator such as shown in FIGS. 1 and 7, or may be configured as an electronic actuator as shown in FIG. 9. Exemplary mechanical actuators include levers, push-buttons, switches, and the like. Exemplary electronic actuators include sensors such as optical sensors, motion sensors, light sensors, pressure sensors, heat sensors, and the like. The first actuator 122 may be positioned in various positions relative to the base 102 and nozzle 120. For example, the first actuator 122 may be positioned above or below the nozzle 120. In an exemplary configuration such as shown in FIG. 1, the first actuator 122 is positioned below the nozzle 120. In such an exemplary configuration, a user may be able to activate the first actuator 122 and dispense a composition onto a cleaning implement or into the user's hand using only one hand.

The second actuator 124 may be configured in different ways. For example, the second actuator 124 may be configured as a mechanical actuator such as shown in FIG. 1. In other exemplary configurations, the second actuator may be configured as an electronic actuator. Exemplary mechanical actuators include levers, push-buttons, switches, and the like. In other exemplary configurations, the sidewall 108 may be flexible and the second actuator 124 may comprise the flexible sidewall 108 of the reservoir 106. In such an exemplary configuration, compression of the sidewall 108 causes the valve 126 of the second dispensing system 132 to open and the composition to dispense there from. Exemplary electronic actuators include sensors such as optical sensors, motion sensors, light sensors, pressure sensors, heat sensors, and the like.

While FIGS. 1 and 7 show two exemplary dispensing devices 100, it is to be appreciated that the components of the dispensing device may be configured in many different ways. For example, the base 102 of the dispensing device 100 may be configured in various ways. The base 102 of the dispensing device 100 may be configured to rest on a rigid surface, such as a countertop. The base 102 may be configured to house components of the dispensing device 100, such as the first dispensing system 130, and to support the refill 104. The base 102 and the refill 104 can be arranged in different configurations relative to each other. For example, as shown in FIG. 1, the nozzle 120 and first actuator 122 are arranged in a side-by-side configuration with the refill 104. In other exemplary configurations, such as shown in FIG. 7, the refill 104 may rest on top of the base 102 and the nozzle 120 and first actuator 122 may be positioned below the refill 104. In other exemplary configurations, the refill 104 may be positioned below the nozzle 120 and first actuator 122. It is to be appreciated that the refill 104 of the dispensing device 100 shown in FIG. 7 is removably connectable with the base 102.

As shown in FIG. 1, the base 102 may include a buffer reservoir 152 for containing an amount of composition. For example, the buffer reservoir 152 may be used to hold a portion of the composition dispensed from the refill 104 using the first dispensing system. In a dispensing device having a buffer reservoir 152, an amount of composition can be dispensed from the base 102 while the refill 104 is disconnected from the base 102.

The base 102 may be comprised of various materials. For example, the base 102 may be comprised of a rigid material, including a rigid polymeric material like polypropylene, metal, or combinations thereof.

In the configuration shown in FIG. 1, the base 102 comprises one or more feet 142 to improve the stability of the base 102 sitting on a rigid surface. Moreover, the feet 142 may be padded to limit movement of the base 102 and to prevent scratching the rigid surface with the bottom of the base 102.

With reference to FIGS. 1 and 2, the reservoir 106 may be configured in various ways. In some exemplary configurations, the bottom wall 110 and/or top wall 112 may be removably connectable with the sidewall 108 of the reservoir 106.

The reservoir 106 may be configured as a dual or multi-chamber reservoir that is capable of separately containing two or more compositions.

The reservoir 106 may be configured in an upright configuration wherein the composition is released from the orifice in an upward direction. The reservoir 106 may also be configured in a downward configuration wherein the composition is released from the orifice in a downward direction.

The reservoir 106 of the refill 104 may be comprised of various materials. For example, the reservoir 106 may be comprised of a rigid or semi-rigid polymeric material such as polyethylene or polypropylene. The reservoir 104 may be comprised of other materials such as metal or glass, for example. In some exemplary configurations, the reservoir 106 may be configured as a polybag. The reservoir may be configured as a multilayer laminated pouch or a bag-in-bottle.

The refill may be configured as a bag-in-bottle system. A bag-in-bottle system may include an inner, deformable reservoir and an outer, rigid reservoir. The inner reservoir is configured to contain the composition in an airless environment, thus not needing an air vent as a conventional refill reservoir. Air can be introduced in the space between the inner and outer reservoir, thereby increasing the air pressure around the inner reservoir, causing the inner reservoir to compress and the composition to dispense therefrom. The composition may also be dispensed from a bag-in-bottle system by sucking the composition out using underpressure. A bag-in-bottle system may be formed using blow-molding technology.

The refill 104 may be configured to stand on a rigid surface independent of the base 102. For example, the bottom wall 110 of the reservoir 106 may be flat in order to stably rest on a rigid surface.

The refill 104 may be connected with the base 102 in various ways. For example, the refill 104 may be slideably or threadably connected with the base 102. In some exemplary configurations, the refill 104 may connect with the base 102 using fasteners, pins, latches, keys and matching key ways, and the like.

The refill 104 may be filled with a composition as presented to the user. When the composition is depleted from the refill 104, the refill may be discarded and replaced with a refill 104 having a fresh supply of a composition. Alternatively, the refill 104 may be replenished with a composition from a separate supply by the user. In such an exemplary configuration, the refill 104 may include a fill port for refilling the reservoir with a composition. In some exemplary configurations, the top or bottom wall 112, 110 of the reservoir may be removable from the sidewall 108 for the purpose of refilling the reservoir 106.

With reference to FIGS. 2 and 3, in a refill configuration comprising an air vent 116, the air vent 116 may be configured in various ways. In some exemplary configurations, the air vent 116 may comprise a valve 150 such as an umbrella valve. An umbrella valve is activated if the pressure inside of the refill 104 is lower than atmospheric pressure, causing atmospheric air to push past the umbrella valve and vent the refill 104. When the composition is not being actively dispensed from the refill 104, the umbrella valve is closed and the composition is unable to exit through the umbrella valve. It is to be appreciated that a minimum distance between the air vent 116 and the feed tube 118 prevents the entrainment of air bubbles into the composition exiting the refill 104. The air vent 116 can be positioned in different locations. As shown in FIG. 2, the air vent may be positioned in the bottom wall 110 of the reservoir 106. In other exemplary configurations, the air vent 116 may be positioned in the top wall 112 or sidewall 108 of the reservoir 106. The air vent 116 may mate with an air vent member 119 of the base 102. It is to be appreciated that the air vent 116 may be configured in a closed configuration when the refill 104 is disconnected from the base 102. When the refill 104 is connected with the base 102, the air vent member 119 of the base 102 may be configured to open the air vent 116 to allow air to enter the reservoir.

As discussed above and as shown in FIG. 1, the base 102 may include a nozzle 120 for dispensing the composition. Any type of nozzle may be used depending upon the physical characteristics of the composition. For example, the nozzle may be configured to dispense the composition as a stream, mist, or a spray. The nozzle may be sized to match the desired flow rate of the composition.

As shown in FIG. 1, the dispensing device 100 may also comprise a cleaning implement holder 146 for holding a cleaning implement 154. The cleaning implement holder 146 may be configured to hold various cleaning implements, such as sponges, brushes, towels, and the like. The cleaning implement may be configured as a combination cleaning implement that includes, for example, a sponge and a brush. The cleaning implement holder 146 may be configured to hold one or more cleaning implements. The cleaning implement holder 146 may be positioned in various locations relative to the base of the dispensing device. The cleaning implement holder 146 may be disposed in an area of the base that is easy for a user to reach when standing in front of the dispensing device. The cleaning implement holder 146 may be integrally formed with the base 102, or may be a separate component attached to the base 102. The cleaning implement holder 146 may be comprised of the same material as the base 102, or may be a different material than the base 102.

Method of Dispensing a Composition

With reference to FIGS. 1-5B, the dispensing device 100 may be used in methods of dispensing various compositions, such as cleaning and personal care compositions. For easy access, the dispensing device 100 may be placed on a rigid surface, such as a countertop or sink. Sometimes, a user may want to dispense a composition 144 into the user's hand or onto a cleaning implement. In such a situation, with the refill 104 connected with the base 102, the user may activate the first actuator 122 of the dispensing device 100 to dispense a quantity of a composition 144 from the base 102. In some exemplary configurations, activation of the first actuator 122 may cause the first dispensing system 130 to dispense a quantity of a composition 144 from the refill 104 through the nozzle 120 of the base 102.

In some instances, a user may hold a cleaning implement in one hand and may use the same hand to activate the first actuator 122. As such, the dispensing device 100 may be configured for one-handed dispensing.

In another exemplary situation, a user may wish to dispense a composition 144 directly onto a surface, such as a soiled dish or clothing item. In such a situation, the user may disconnect the refill 104 from the base 102 and activate the second actuator 124 to dispense a quantity of the composition directly from the refill 104. In some exemplary configurations, activation of the second actuator 124 may cause the second dispensing system 132 to dispense a quantity of the composition 144 directly from the refill 104. The refill 104 may offer a user a flexible design that can be placed on a countertop or easily held in a user's hand for various different dispensing purposes.

In an exemplary configuration wherein the first mode of operation includes use of an electronic dispensing system, with reference to FIGS. 1-5B, the refill 104 is connected with the feed tube 118 of the base 102. Activation of the first actuator 122 closes the electric circuit, causing the electric motor 134 to start up. In an exemplary configuration comprising an electronic pump 138 such as shown in FIG. 4, the electric motor 134 drives the electronic pump 138 to force the composition from the refill 104 into the feed tube 118. From the feed tube 118, the composition 144 flows through the electronic pump 138 in the base 102 and out of the nozzle 120. When the electronic dispensing system is activated, the valve 128 adjacent to the nozzle 120 is configured to open to allow the composition to flow out of the nozzle 120.

In an exemplary configuration wherein the second mode of operation includes use of a mechanical dispensing system, the refill 104 is disconnected from the base. In an exemplary configuration such as shown in FIG. 1 wherein the second actuator 124 comprises the sidewall 108 of the reservoir 106, the user compresses the sidewall 108, which forces the valve 126 of the second dispensing system 132 to open and the composition to flow out of the orifice 114.

The first dispensing system 130 may be configured to dose a predetermined amount of composition 144 in a single activation of the first actuator 122. The second dispensing system 132 may be configured such that the user is able to control the amount of composition 144 dosed from the refill 104 during a single activation of the second actuator 124. For example, the user can control the amount of composition dosed from the refill 104 in one use by holding down the second actuator 124 for a certain length of time. That is, the longer the second actuator 124 is activated the more composition 144 that is dispensed from the refill 104. In other exemplary configurations, a single activation of the second actuator 124 may dose a predetermined amount of composition 144 from the refill 104.

The dispensing device 100 may be use to dispense a composition onto a target surface. The target surface can be any surface, including a user's hand, a cleaning implement, or a soiled surface. As shown in FIGS. 7-9, the target surface may be a cleaning implement 154. When the target surface is a cleaning implement 154, such as shown in FIGS. 7-9, the first actuator 122 may be activated with the cleaning implement 154 or with a user's hand.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern. While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing device selectively operable in a first mode of operation and a second mode of operation, the device comprising a base and a refill removably connectable with the base, the base comprising:

a first dispensing system;

a first actuator communicably connected with the first dispensing system, the refill comprising a reservoir having a sidewall and an orifice, and a second actuator;

wherein the first dispensing system is in fluid communication with the refill in the first mode of operation, and wherein the refill is disconnected from the base in the second mode of operation; and a nozzle, wherein the nozzle is in fluid communication with the first dispensing system and wherein the nozzle is located above the first actuator.

2. The device of claim 1, wherein the refill comprises a second dispensing system in fluid communication with the orifice of the refill and the second actuator communicably connected with the second dispensing system.

3. The device of claim 1, wherein in the first mode of operation, the first actuator activates the first dispensing system to dispense a composition from the base, wherein in the second mode of operation the second actuator activates a second dispensing system of the refill to dispense the composition from the refill.

4. The device of claim 1, wherein the first dispensing system is configured as an electronic dispensing system.

5. The device of claim 1, wherein the second dispensing system is configured as a mechanical dispensing system.

6. The device of claim 1, wherein the sidewall of the reservoir is flexible, wherein the second actuator comprises the flexible sidewall.

7. The device of claim 1, wherein the first actuator comprises a mechanical actuator.

8. The device of claim 1, wherein the base further comprises a cleaning implement holder.

9. A dispensing device comprising:

a base having a feed tube and a nozzle;

a refill removably connectable with the base, the refill comprising a reservoir, the reservoir having a sidewall and an orifice, wherein the feed tube of the base is releasably connectable with the orifice of the refill, wherein the sidewall of the reservoir is flexible; and an electronic pump in fluid communication with the feed tube and the nozzle;

a first actuator communicably connected with the electronic pump, wherein the nozzle is disposed above the first actuator; and a second actuator communicably connected with the valve of the refill, wherein the second actuator comprises the flexible sidewall.

10. The device of claim 9, wherein the first actuator comprises an optical sensor.

11. The device of claim 9, wherein the first actuator comprises a mechanical actuator.

12. The device of claim 9, wherein the refill is positioned above the base.

* * * * *